United States Patent [19]

Bardenhagen et al.

[11] 4,377,098

[45] Mar. 22, 1983

[54] APPARATUS FOR SIMULTANEOUS SEVERING OF PLURAL MOVING PARALLEL RODS

[75] Inventors: Dietrich Bardenhagen, Hamburg; Nikolaus Häusler, Oststeinbek; Helmut Niemann, Hamburg; Heinz Greve, Hamburg; Karl-Heinz Schlüer, Hamburg, all of Fed. Rep. of Germany

[73] Assignee: Hauni-Werke Körber & Co. KG., Hamburg, Fed. Rep. of Germany

[21] Appl. No.: 248,012

[22] Filed: Mar. 26, 1981

[30] Foreign Application Priority Data

Mar. 29, 1980 [DE] Fed. Rep. of Germany ..... 3012343

[51] Int. Cl.[3] ..... A24C 5/28

[52] U.S. Cl. ..... 83/310; 83/318; 83/331; 83/580

[58] Field of Search ..... 83/310, 318, 320, 321, 83/329, 330, 331, 580

[56] References Cited

U.S. PATENT DOCUMENTS

| | | | |
|---|---|---|---|
| Re. 30,598 | 5/1981 | Spencer | 83/329 X |
| 1,591,069 | 7/1926 | Witte | 83/320 X |
| 1,637,803 | 8/1927 | Bronander | 83/320 |
| 3,104,579 | 9/1963 | Blankenship | 83/850 X |
| 3,164,048 | 1/1965 | Wray et al. | 83/329 X |
| 3,782,229 | 1/1974 | Cristiani | 83/310 X |
| 3,830,126 | 8/1974 | Reinge | 83/310 |

*Primary Examiner*—James M. Meister

*Attorney, Agent, or Firm*—Kontler, Grimes & Battersby

[57] ABSTRACT

Apparatus for simultaneously severing plural parallel filter rods which issue from an extruder and move axially at the same speed has a knife mounted on a holder which is rotatable about an axis extending in parallelism with the axes of the rods. The knife holder moves along a circular path in a plane which is parallel to the axes of the rods. The knife holder and suitable guides for the rods are mounted on cranks whose crankshafts rotate about axes making a right angle to the direction of movement of the rods and causing the knife and the guides to move back and forth in and counter to the direction of axial movement of the rods. The shaft for the knife holder is rotated at twice the speed of the crankshafts and the cutting edge of the knife severs all of the rods in immediate proximity of the guides during each second revolution of the holder.

9 Claims, 1 Drawing Figure

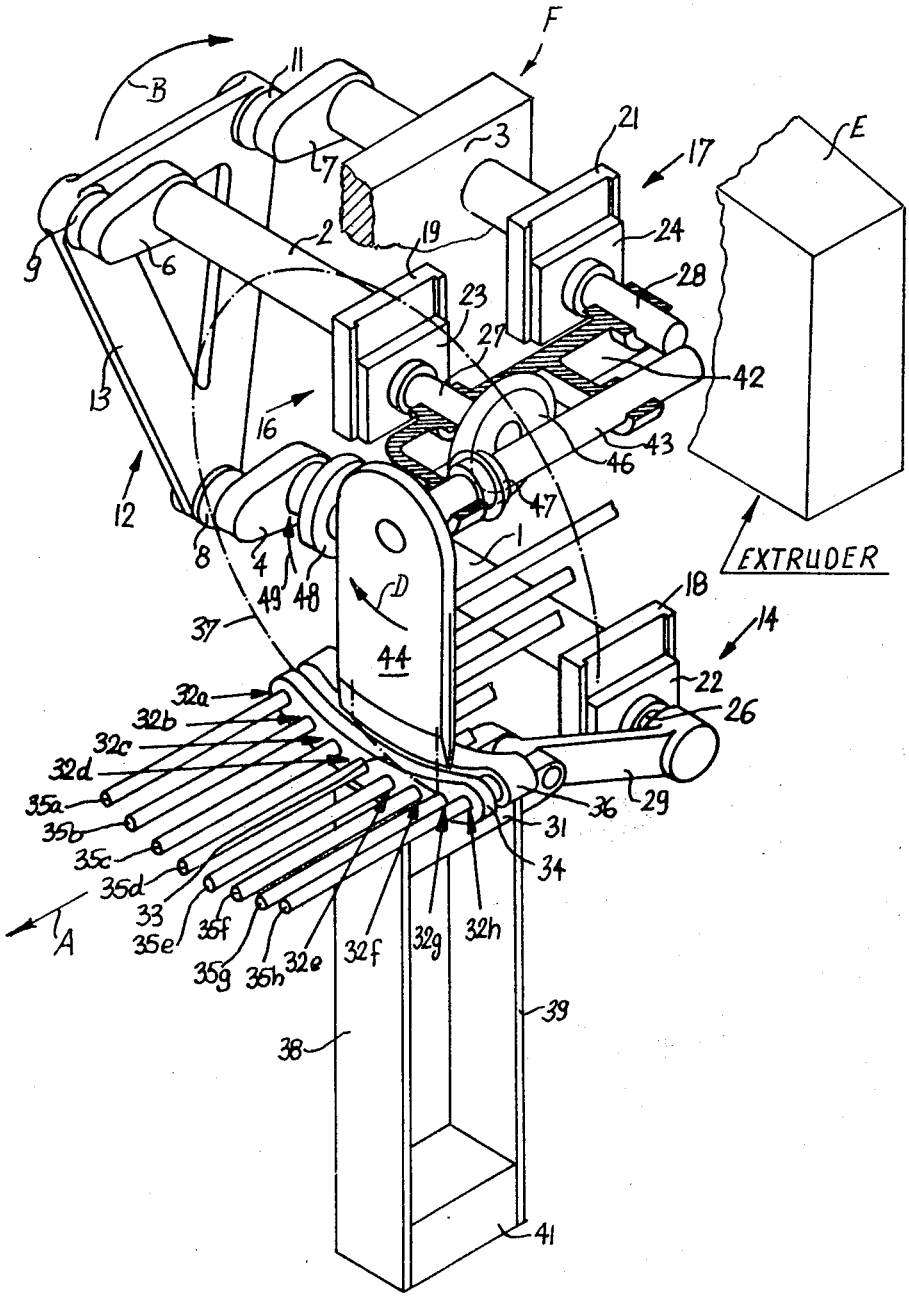
F
B
11
7
3
21
17
E
9
6
2
19
24
28
23
27
42
13
16
43
46
12
47
1
EXTRUDER
8
4
49
48
D
18
14
37
44
22
26
32a
32b
32c
32d
35a
35b
35c
35d
33
35e
35f
35g
35h
32e
32f
32g
32h
31
34
36
29
A
39
38
41

APPARATUS FOR SIMULTANEOUS SEVERING OF PLURAL MOVING PARALLEL RODS

BACKGROUND OF THE INVENTION

The present invention relates to apparatus for severing rod-shaped commodities, especially for severing rods which can be subdivided into components constituting or forming part of rod-shaped smokers' products. More particularly, the invention relates to improvements in apparatus for simultaneous severing of several parallel rods which move lengthwise in the course of the severing operation. Still more particularly, the invention relates to improvements in apparatus for simultaneous severing, at selected intervals, of continuous rod-shaped commodities which move lengthwise in parallelism with and close to each other.

German Patent No. 404,901 discloses a cigarette making machine which can simultaneously produce several parallel cigarette rods. The machine comprises a discrete severing apparatus (also known as cutoff) for each cigarette rod. Each cutoff is designed to sever the corresponding cigarette at regular intervals so that each rod yields a file of plain cigarettes of desired length. A cutoff for cigarettes is a very complex, sensitive and expensive apparatus. Therefore, a rod making machine with two, three or more discrete cutoffs is extremely costly and requires a substantial amount of maintenance because each and every additional cutoff contributes to the initial cost, to the sensitivity, and to the maintenance cost of such machines.

OBJECTS AND SUMMARY OF THE INVENTION

An object of the invention is to provide a relatively simple, compact, rugged and inexpensive apparatus which can simultaneously sever two or more moving rod-shaped commodities, especially commodities which can be subdivided into rod-shaped articles constituting or forming part of smokers' products.

Another object of the invention is to provide a simple and compact cutoff for continuously extruded filter rods or analogous rod-shaped bodies which move lengthwise in the course of the severing operation.

A further object of the invention is to provide a cutoff which occupies little room in a cigarette making, filter rod making or analogous machine, which can be installed in an existing machine that turns out several parallel rod-shaped commodities at a time, and which can be readily adjusted so as to subdivide each of a plurality of continuous rods into discrete rod-shaped articles or sections of desired length.

An additional object of the invention is to provide novel and improved means for properly guiding the continuously produced and continuously advancing rods in an apparatus of the above outlined character.

Another object of the invention is to provide a novel and improved mounting for the device which simultaneously severs several parallel axially moving rods in a cutoff of the above outlined type.

Another object of the invention is to provide novel and improved drive means for the moving parts of the above outlined apparatus.

Still another object of the invention is to provide the apparatus with novel and improved means for synchronizing the movements of severing means with the movements of rod guiding means.

A further object of the invention is to provide novel and improved counterknives for the moving severing device of the above outlined apparatus.

The invention is embodied in an apparatus for simultaneously severing a plurality of parallel rods which move axially at the same speed, along predetermined paths and in a predetermined direction, particularly for subdividing continuous rods into sections which constitute or form part of rod-shaped smokers' products. The apparatus comprises a knife having a cutting edge arranged to repeatedly orbit about an axis which is at least substantially parallel to the direction of axial movement of the rods and to thereby move along a further path which intersects the predetermined paths (of the rods) during a portion of each $n^{th}$ orbital movement of the cutting edge about the aforementioned axis (n is a whole number including one, two, etc.), a plurality of rod guide means (one for each rod) provided in close proximity of the further path to guide and support the respective rods during severing by the cutting edge of the orbiting knife, and means (e.g., several discrete cranks) for moving the knife and the guide means in the direction of movement of the rods while the cutting edge of the knife serves the rods by intersecting the predetermined paths. The knife is preferably mounted on (e.g., separably secured to) suitable holder means which is mounted for rotation about the aforementioned axis. Such axis is defined by a shaft which is parallel to the rods, and the apparatus preferably further comprises a bearing for the shaft. The moving means then includes a plurality of parallel cranks having arms supporting the bearing and crankshafts which carry the arms and are driven to rotate about their respective axes which are normal to the axis of the shaft for the knife holder means.

The aforementioned number n may equal two. The apparatus then comprises means for rotating the shaft for the knife holder means at twice the speed of the crankshafts. For example, one of the aforementioned crank arms may carry a pin which is eccentric to the respective crankshaft and carries a first bevel gear mating with a second bevel gear on the shaft for the knife holder means. The ratio of the bevel gears is such that the RPM of the crankshafts is half the RPM of the shaft for the knife holder means. The cutting edge of the knife then severs the rods during each second revolution of the holder means about the axis of the shaft.

The apparatus preferably comprises a common carrier for all of the rod guide means. Such carrier may comprise two sections each of which carries or defines one-half of each guide means. The sections are separated by a gap for the cutting edge of the knife so that the knife severs those portions of the rods which extend across the gap. The moving means then comprises a crank which is operable to move the carrier in and counter to the direction of axial movement of the rods.

All in all, the moving means may comprise at least one first crank for moving the knife in and counter to the direction of axial movement of the rods (and preferably also for transmitting torque to means for orbiting the knife about the aforementioned axis) and a second crank which moves the rod guide means in and counter to the direction of axial movement of the rods. The cranks preferably have crank pins which are eccentric to the respective crankshafts, and the apparatus then preferably comprises a common frame for the pins to thus synchronize the movements of all cranks.

The novel features which are considered as characteristic of the invention are set forth in particular in the appended claims. The improved severing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary perspective view of a severing apparatus which is constructed and assembled in accordance with an embodiment of the present invention and is designed to simultaneously sever eight parallel rod-shaped commodities.

DESCRIPTION OF THE PREFERRED EMBODIMENTS

The drawing illustrates a severing apparatus (also known as cutoff) which severs to repeatedly sever a plurality of parallel rod-shaped commodities in the form freshly extruded filter rods 35*a*, 35*b*, 35*c*, 35*d*, 35*e* 35*f*, 35*g* and 35*h*. The rods move continuously and lengthwise (axially) as indicated by the arrow A and issue from the orifices of a suitable extruder E. It goes without saying that, since the severing apparatus comprises a rapidly rotating knife 33, it is confined in a suitable housing or enclosure which has been omitted in the drawing for the sake of clarity. The housing is mounted in or on a frame or support which can form part of the filter rod extruding machine and a portion of which is indicated at F. The frame F supports three parallel horizontal crankshafts 1, 2 and 3 which are rotatably mounted therein so that they can turn about their respective axes but cannot move axially and/or sideways. The left-hand end portions of the crankshafts 1, 2 and 3 respectively carry crank arms 4, 5, 6, 7 with eccentric crank pins (not shown) which are rotatable in bearings 8, 9, 11 provided on a parallel guide unit 12 which includes a triangular frame 13. The aforementioned pins are eccentric with reference to the corresponding crankshafts 1, 2 and 3. When the cranks 14, 16, 17 which include the respective crankshafts 1, 2, 3 are rotated, the frame 13 performs a rotary movement in the direction indicated by arrow B.

The cranks 14, 16, 17 respectively further comprise elongated arms composed of ways 18, 19, 21 which are rigidly connected with the respective crankshafts 1, 2, 3 and slides 22, 23, 24 which are reciprocably installed in the corresponding ways 18, 19, 21. Crank pins 26, 27, 28 are respectively provided on the slides 22, 23, 24. The slides 22, 23, 24 can be adjusted in the longitudinal direction of the tracks defined by the respective ways 18, 19, 21 so as to change the throws of the corresponding cranks 14, 16, 17. The throw of each of the three cranks is the same, and the extent of such throw depends on the desired length of filter rod sections which are to be obtained by severing the continuously extruded rods 35*a* to 35*h* by the orbiting knife 33 which is removably installed in a rotary knife holder 44 secured to a horizontal shaft 43 which extends in parallelism with the direction indicated by the arrow A, i.e., in parallelism with the paths of lengthwise movement of filter rods 35*a* to 35*h*.

The crank pin 26 of the crank 14 is connected with one end portion of a connecting rod 29 which is further articulately connected with a carrier 31. The carrier 31 supports or defines eight rod guides 32*a*, 32*b*, 32*c*, 32*d*, 32*e*, 32*g*, 32*h*, one for each of the eight filter rods 35*a* to 35*h*. The guides 32*a* to 32*h* are pairs of bores machined into two spaced-apart sections or portions 34, 36 of the carrier 31. The spacing between the sections 34 and 36 suffices to provide room for the passage of the cutting edge of the knife 33. Each of the sections 34, 36 has eight bores and each bore of the front section 34 is aligned with a bore of the rear section 36 so that a filter rod can advance through the registering bore of the rear section 36, thereupon across the gap between the sections 34, 36 and finally through the registering bore of the front section 34. The axes of the guides 32*a* to 32*h* are disposed in an arcuate plane having a radius of curvature on the axis of rotation of the knife holder 44 at the time when the knife 33 severs the rods 35*a* to 35*h*. The path of movement of the cutting edge of the knife 33 during severing of the rods 35*a* to 35*h* is indicated by a phantom-line circle 37. The severing operation takes place while the cutting edge of the knife 33 travels through the gap between the sections 34, 36 of the carrier 31 for the rod guides 32*a* to 32*h*. The direction of rotation of the knife holder 44 is indicated by the arrow D. The carrier 31 is mounted at the upper ends of two resilient elements here shown as leaf springs 38 and 39 which are normally disposed in two parallel vertical planes and the lower end portions of which are secured to a base 41.

The crank pins 27 and 28 of the upper cranks 16 and 17 support a bearing member 42 which extends at right angles to the axes of the shafts 2 and 3. The bearing member 42 supports the shaft 43 for the knife holder 44. The shaft 43 is horizontal and extends in parallelism with the axes of the filter rods 35*a* to 35*h*, i.e., at right angles to the axes of the crankshafts 1, 2 and 3. That portion of the shaft 43 which is located behind the knife holder 44 (as considered in the direction of the arrow A) is provided with a first bevel gear 47 which is in mesh with a larger second bevel gear 46 on the crank pin 27 of the crank 16. The transmission ratio of the bevel gears 46, 47 is two-to-one, i.e., the shaft 43 rotates at twice the speed of the crank pin 27. Otherwise stated, the shaft 43 completes two revolutions in response to each revolution of the crankshaft 2.

The means for driving the rotary components of the apparatus which is shown in the drawing comprises a driver gear 48 which is mounted on the shaft 1 and receives torque from the main prime mover of the machine including the extruder E. The arrow 49 indicates the direction of rotation of the gear 48, i.e., the crankshaft 1 is driven in a clockwise direction and the frame 13 of the guide unit 12 causes the crankshafts 2 and 3 to rotate in the same direction (note the arrow B).

When the gear 48 rotates the crankshaft 1 and the latter rotates the crankshafts 2 and 3 through the medium of the frame 13, the cranks 16 and 17 cause the shaft 43 for the knife holder 44 to travel along a circular path so that the holder 44, which rotates about the axis of the shaft 43, simultaneously performs a second movement which involves rotation in a vertical plane making a right angle with the plane of the path 37. The just mentioned plane of orbital movement of the shaft 43 is parallel to the direction which is indicated by the arrow A. The momentary component of velocity of the shaft 43 and knife holder 44 in and counter to the direction of movement of the filter rods 35*a* to 35*h* (arrow A) equals the velocity of the rod guides 32*a* to 32*h* because the carrier 31 receives motion from the crank 14 through the medium of the connecting rod 29 and the crank 14 is driven at the speed of the cranks 16 and 17. The direction and magnitude of the just mentioned component correspond to those of the continuously advancing rods 35*a* to 35*h* when the cranks 14, 16, 17 assume their six o'clock positions and rotate in a clockwise direction, as viewed in the drawing. Since the shaft 43 for the knife holder 44 rotates at twice the speed of the crankshafts 1, 2 and 3, the angles which are covered by the cranks 14, 16, 17 during severing of the rods 35*a* to 35*h* are relatively small so that the rods are not damaged as a result of movement of the cutting edge toward and away from a position in which its speed equals the speed of the rods in the course of a severing operation. Such absence of damage is also attributable to the fact that the rod guides 32*a* to 32*h* and the knife holder 44 perform substantially sinusoidal movements so that the differences between the speed of such parts before and after the cranks 14, 16 and 17 assume their six o'clock positions are negligible. The arrangement is such that the knife 33 penetrates into the gap between the sections 34, 36 of the carrier 31 only during each second revolution of the shaft 43. The severing operation takes place when the knife holder 44 moves toward, through and beyond the six o'clock position during each second revolution of the shaft 43. At the same time, the cranks 14, 16, 17 must move through the twelve o'clock positions. In other words, the pins 26 to 28 of the cranks 14, 16 and 17 are lifted at such time so that the knife 33 cannot reach the advancing rods 35*a* to 35*h*. However, when the shaft 43 is held in its lower end position while the knife 33 moves through the six o'clock position, the cutting edge of the knife severs all eight rods 35*a* to 35*h* and causes such rods to simultaneously yield eight filter rod sections of desired length. As mentioned before, the length of the filter rod sections is determined by the positions of slides 22, 23, 24 with reference to the corresponding ways 18, 19, 21.

An important advantage of the improved severing apparatus is that it is extremely simple, rugged, compact and inexpensive. In fact, the cost of the apparatus which is shown in the drawing does not exceed the cost of a conventional cutoff which is capable of severing only one rod at a time.

The fact that the cutting edge of the knife 33 severs a relatively large number of moving parallel rods at a time, namely, during each $n^{th}$ revolution of the holder 44, does not affect the quality of the cuts because the rod guides 32*a* to 32*h* are immediately adjacent to that portion of the path of movement of the cutting edge wherein the knife 33 severs the rods in the gap between the sections 34, 36 of the common carrier 31 for all of the rod guides. The holder 44 can be rotated at a very high speed which is twice the speed of rotation of crankshafts 1, 2 and 3 about their respective axes so that the interval of severing during each $n^{th}$ revolution of the holder 44 (namely, during each second revolution if the means for moving the holder 44 and the guides 32*a* to 32*h* in and counter to the direction of movement of the rods 35*a* to 35*h* is constructed in the illustrated manner and the shaft 43 rotates at twice the speed of the crankshafts 1 to 3) is extremely short. The severing operation takes place when the axis of the shaft 43 is nearest to the paths of movement of the rods 35*a* to 35*h*; this ensures that the cutting edge of the knife 33 makes a clean cut across each and every rod while the cutting edge moves in the gap between the sections 34, 36 of the carrier 31. The shaft 43 moves upwardly and away from the paths of the rods 35*a* to 35*d* immediately upon completion of a severing operation and moves sufficiently close to the paths for the rods only after each of the crankshafts 1 to 3 completes a full revolution or practically a full revolution, i.e., after the shaft 43 completes two revolutions about its own axis.

The feature that the throws of all three cranks are the same ensures that, during severing, the knife 33 and the guides 32*a* to 32*h* move forwardly (arrow A) at or close to the speed of the rods 35*a* to 35*h* while the knife 33 simultaneously orbits about the axis of the shaft 43. The speed of the drive gear 48 can be readily selected in such a way that the speed of movement of the rod guides 32*a* to 32*d* in the direction of the arrow A matches the speed or rate at which the rods 35*a* to 35*h* issue from the corresponding orifices of the extruder E. The exact construction of the extruder forms no part of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for simultaneously severing a plurality of parallel rods which move axially at the same speed along predetermined paths and in a predetermined direction, particularly for subdividing continuous rods into sections which constitute or form part of smokers' products, comprising a knife having a cutting edge arranged to repeatedly orbit about an axis which is at least substantially parallel to said direction and to thereby move along a further path which intersects said predetermined paths at least during a portion of each $n^{th}$ orbital movement of said cutting edge about said axis, a shaft defining said axis and supporting said knife, and a bearing for said shaft; a plurality of rod guide means, one for each rod, provided in close proximity of said further path; and means for moving said guide means and said knife in said direction while said cutting edge intersects said predetermined paths, including a plurality of parallel cranks having arms supporting said bearing and crankshafts supporting said arms and rotatable about axes which are normal to the axis of said shaft.

2. The apparatus of claim 1, further comprising holder means for said knife, said holder means being mounted for rotation about said axis.

3. The apparatus of claim 1, wherein n equals two.

4. The apparatus of claim 3, further comprising means for rotating the shaft for said knife at twice the speed of said crankshaft.

5. The apparatus of claim 4, wherein one of said arms comprises a pin which is eccentric to the respective crankshaft and said rotating means comprises mating first and second bevel gears one of which rotates with said pin and the other of which rotates with said shaft.

6. The apparatus of claim 1, further comprising a common carrier for said guide means.

7. The apparatus of claim 6, wherein said moving means includes an additional crank operable to move said carrier in and counter to said direction.

8. The apparatus of claim 1, wherein said moving means further comprises a plurality of pins, one for each of said crankshafts and each eccentric to the respective crankshaft, and further comprising a common frame for said pins.

9. Apparatus for simultaneously severing a plurality of parallel rods which move axially at the same speed along predetermined paths and in a predetermined direction, particularly for subdividing continuous rods into sections which constitute or form part of smokers' products, comprising a knife having a cutting edge arranged to repeatedly orbit about an axis which is at least substantially parallel to said direction and to thereby move along a further path which intersects said predetermined paths at least during a portion of each $n^{th}$ orbital movement of said cutting edge about said axis; a plurality of rod guide means, one for each rod, provided in close proximity of said further path; and means for moving said guide means and said knife in said direction while said cutting edge intersects said predetermined paths, comprising at least one first crank for moving said knife in and counter to said direction and a second crank for moving said guide means in and counter to said direction, the throw of said first crank being equal to the throw of said second crank.

* * * * *